US010898943B2

(12) United States Patent
Huff et al.

(10) Patent No.: US 10,898,943 B2
(45) Date of Patent: Jan. 26, 2021

(54) SELF-PIERCING RIVET DEVICE AND METHOD OF OPERATING A SELF-PIERCING RIVET DEVICE TO INHIBIT INCORRECT DIE USAGE

(71) Applicant: Ford Global Technologies, LLC, Dearborn, MI (US)

(72) Inventors: Garret Sankey Huff, Ann Arbor, MI (US); Amanda Freis, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 26 days.

(21) Appl. No.: 16/140,963

(22) Filed: Sep. 25, 2018

(65) Prior Publication Data

US 2020/0094310 A1 Mar. 26, 2020

(51) Int. Cl.
*B21J 15/28* (2006.01)
*B21J 15/02* (2006.01)

(52) U.S. Cl.
CPC ..... *B21J 15/285* (2013.01); *B21J 15/025* (2013.01)

(58) Field of Classification Search
CPC . B21J 15/285; B21J 15/025; Y10T 29/49943; Y10T 29/49956; Y10T 29/5118; Y10T 29/5377
See application file for complete search history.

(56) References Cited

U.S. PATENT DOCUMENTS

| | | | | |
|---|---|---|---|---|
| 5,752,305 | A | 5/1998 | Cotterill et al. | |
| 6,676,000 | B2 | 1/2004 | Lang et al. | |
| 6,964,094 | B2 * | 11/2005 | Kondo | B21J 15/025 29/243.53 |
| 7,370,399 | B2 | 5/2008 | Lang et al. | |
| 7,475,473 | B2 | 1/2009 | Lang et al. | |
| 7,673,377 | B2 | 3/2010 | Clew | |
| 7,721,405 | B2 | 5/2010 | Lang et al. | |
| 7,797,126 | B2 * | 9/2010 | Wenzel | B21J 15/025 29/798 |
| 8,151,454 | B2 * | 4/2012 | Opper | B21J 15/36 29/798 |
| 9,120,140 | B2 | 9/2015 | Moision et al. | |
| 9,149,862 | B2 | 10/2015 | Draht | |
| 9,149,863 | B2 | 10/2015 | Draht et al. | |
| 9,776,239 | B2 | 10/2017 | Craythorn et al. | |

FOREIGN PATENT DOCUMENTS

| | | |
|---|---|---|
| CN | 206520245 | 9/2017 |
| CN | 206856049 | 1/2018 |
| DE | 102012216838 | 6/2014 |
| GB | 1487098 | 9/1977 |

* cited by examiner

*Primary Examiner* — Jason L Vaughan
*Assistant Examiner* — Amanda Kreiling
(74) *Attorney, Agent, or Firm* — Burris Law, PLLC

(57) ABSTRACT

A method of operating a riveting tool includes mounting a die in an installed position, determining an actual stroke distance of the riveting tool, comparing the actual stroke distance to a predetermined stroke distance that is based on a desired rivet location, and operating or not operating the riveting tool to install a rivet into workpieces, based on the result of the comparison.

18 Claims, 5 Drawing Sheets

SELF-PIERCING RIVET DEVICE AND METHOD OF OPERATING A SELF-PIERCING RIVET DEVICE TO INHIBIT INCORRECT DIE USAGE

FIELD

The present disclosure relates to a self-piercing rivet device configured to inhibit incorrect die usage and a method of operating a self-piercing rivet device that inhibits incorrect die usage.

BACKGROUND

The statements in this section merely provide background information related to the present disclosure and may not constitute prior art.

Self-piercing rivet (SPR) tools typically have a setter and a die. The setter is configured to hold the workpieces against the die while also pressing the rivet into the workpieces. The rivet and workpieces deform as they are pressed against the die. Over time, the dies can wear out and need replacement. Thus, the die is typically configured to be replaceable relative to the frame of the SPR tool. Additionally, some SPR tools are configured to be able to operate with different rivets (e.g., rivets of different types or geometries). For example, some SPR tools can operate with rivets that are the same type (e.g., diameter and style), but of different lengths. Different rivets typically require different dies to accommodate the differences in geometry of the rivet.

In some situations, it can be difficult for a user of the SPR tool to differentiate between different dies that correspond to different rivet geometries. Thus, a user may accidentally install the incorrect die on the SPR tool. Performing a complete riveting operation (i.e., riveting workpieces together), when the installed die is incorrect for the rivet being used, can result in damage to the workpieces and the SPR tool, leading to costly scrapped parts and machine downtime.

These issues related to the use of SPR tools with different dies are addressed by the present disclosure.

SUMMARY

In one form, a method of operating a riveting tool includes mounting a die in an installed position, determining an actual stroke distance of the riveting tool, comparing the actual stroke distance to a predetermined stroke distance that is based on a desired rivet location, and installing or not installing a rivet into workpieces, based on the result of the comparison. In a variety of alternate forms of the present disclosure: the method further includes receiving an input of a desired rivet location identifier that corresponds to the desired rivet location; the riveting tool includes a punch configured to press the rivet toward the die, and the step of determining the actual stroke distance includes determining an operating pressure or force of the punch; the step of determining the actual stroke distance further includes determining a height of the die or a position of a setter aligned with the die when the operating pressure or force exceeds a threshold operating pressure or force; the method further includes positioning workpieces between the setter and the die and moving the punch to press the rivet against the workpieces; the threshold operating pressure or force is insufficient for the rivet to significantly deform the workpieces against the die; the step of determining the actual stroke distance includes determining a position of the punch when the operating pressure or force exceeds a threshold operating pressure or force; the method further includes determining a die height or a setter position based on thicknesses of the workpieces, a length of the rivet, and the position of the punch when the operating pressure or force exceeds the threshold operating pressure or force; the threshold operating pressure or force is insufficient for the rivet to significantly deform the workpieces; the operating pressure or force is calculated based on characteristics of an actuator that is configured to move the punch; the step of determining the actual stroke distance includes operating a servomotor configured to move the setter toward the die and measuring a servomotor rotational displacement when the setter contacts the workpieces; the method further includes indicating the result of the comparison by at least one of a visual cue, an audible cue, or a tactile cue; the die is one of a set of dies, each die of the set of dies corresponding to a different set of riveting characteristics, wherein each die of the set of dies has a different height when mounted in the installed position;

In another form, a method of operating a riveting tool includes positioning workpieces between a setter and a die, pressing a rivet against the workpieces until an operating force exceeds a threshold, comparing an actual stroke distance to a predetermined stroke distance when the operating force exceeds the threshold, and operating or not operating the riveting tool in a manner to install the rivet into the workpieces, based on the comparison result. In a variety of alternate forms of the present disclosure: the method further includes indicating the comparison result by at least one of a visual cue, an audible cue, and a tactile cue; the predetermined stroke distance is based on a rivet location identifier; the method further includes moving a frame of the riveting tool with a robotic arm to position the workpieces between the setter and the die at a rivet location, sending the rivet location identifier from the robotic arm to a control module of the riveting tool when the riveting tool is at the rivet location, and loading a combination of riveting characteristics from a joining schedule, the riveting characteristics corresponding to the rivet location identifier and including the predetermined stroke distance; the die is one of a set of dies, each die of the set of dies corresponding to a different set of riveting characteristics, each die of the set of dies having a different height when mounted in an installed position on a frame of the riveting tool.

In another form, a riveting tool includes a frame, a plurality of dies, and a control module. The plurality of dies are interchangeably mountable to the frame and have different die heights when mounted thereon. The control module is configured to compare a desired stroke distance with an actual stroke distance, and to operate or not operate the riveting tool to install a rivet into workpieces based on the comparison result. The desired stroke distance is based on a desired rivet location received by the control module. In a variety of alternate forms of the present disclosure: the riveting tool further includes an output device in communication with the control module, the output device being configured to output at least one of a visual cue, an audio cue, and a tactile cue indicative of the comparison result; the control module is configured to determine the actual stroke distance based on an operating force of the riveting tool and a position of a setter when the operating force exceeds a threshold operating force, the threshold operating force being insufficient for the rivet to significantly deform the workpieces.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
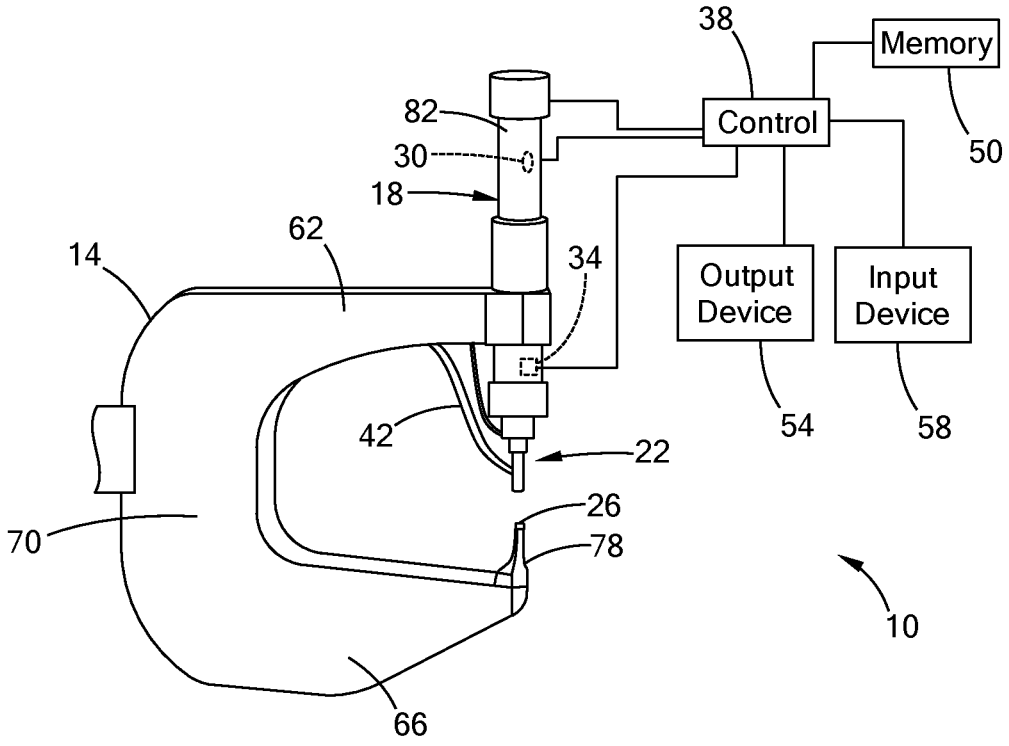
FIG. 1 is a perspective view of a self-piercing rivet device in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

With reference to FIG. 1, a rivet tool 10 for self-piercing rivets is illustrated. The rivet tool 10 includes a frame 14, an actuator 18, a setter 22, at least one die 26, and a control module 38. In the example provided, the rivet tool 10 also includes a rivet feed tube 42, a data storage device 50, an output device 54, and an input device 58. The rivet tool 10 can also include one or more sensors (e.g., first sensor 30 and second sensor 34).

In the example provided, the frame 14 can optionally include a die post 78 that is mounted to an end of a bottom member 66, though other configurations can be used. The die post 78 is configured to support the die 26 so that the die 26 is aligned with the setter 22, as discussed in greater detail below. In an alternative configuration, not specifically shown, the frame 14 lacks the die post 78 and the bottom member 66 is configured to directly support the die 26 aligned with the setter 22.

Returning to the example provided, the actuator 18 is mounted to a top member 62 that is connected to the bottom member 66 by a riser member 70. The actuator 18 can be any type of actuator suitable for operating a self-piercing rivet tool by producing linear movement of the setter 22. For example, the actuator 18 can be a hydraulic piston-cylinder type actuator, a motor driven actuator a combination of a hydraulic piston-cylinder and a motor, or a flywheel type actuator. Other constructions of the actuator 18 can be used and some non-limiting examples of actuator and setter constructions can be found in U.S. Pat. Nos. 9,149,863, 7,721,405, 7,370,399, 9,149,862, 6,676,000, 7,475,473, 5,752,305, 7,673,377, and GB 1,487,098, the disclosures of which are incorporated herein by reference in their entireties.

The setter 22 is coupled to the actuator 18 such that operation of the actuator 18 moves the setter 22 relative to the frame 14 in a linear motion toward and away from the installed die 26 (i.e., the die 26 is in the installed position when it is mounted on the die post 78 or directly to the bottom member 66 and aligned with the setter 22).

Figure 2:
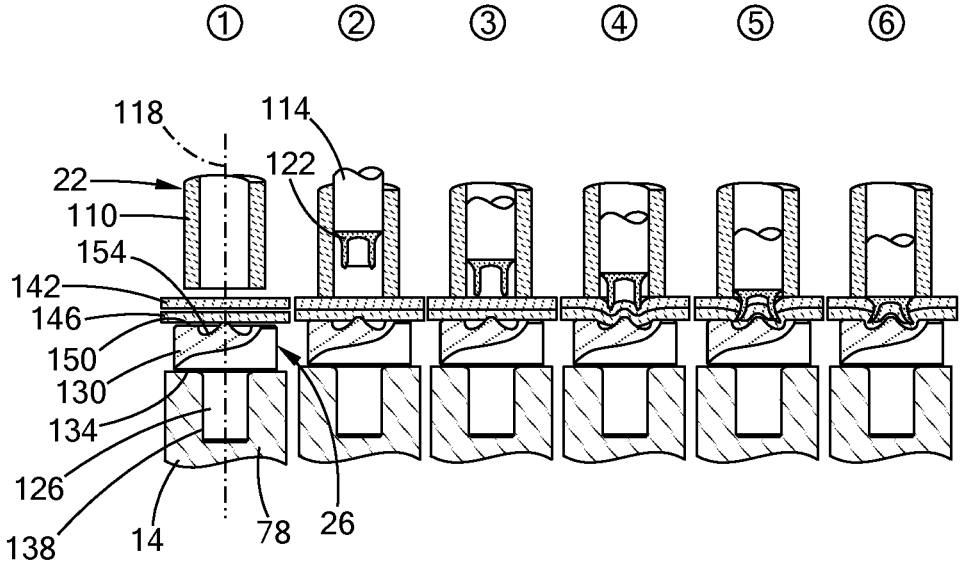
FIG. 2 is partial cross-sectional view of a portion of the self-piercing rivet device of FIG. 1, illustrating sequential steps during a riveting operation of workpieces.

Referring to FIGS. 1 and 2, the setter 22 includes a nose 110 and a punch 114. The nose 110 is a hollow, generally cylindrical body disposed about a riveting axis 118. The riveting axis 118 passes through the center of the nose 110 and the center of the die 26. The punch 114 is a cylindrical member that is disposed about the riveting axis 118 within the interior chamber of the nose 110. The punch 114 is axially movable relative to the nose 110. The nose 110 and punch 114 are coupled to the actuator 18 such that operation of the actuator 18 can move the nose 110 and punch 114 axially in accordance with the steps discussed below.

Referring to FIG. 2, sequential steps of a self-piercing riveting operation are illustrated. At step 1, the die 26 is mounted in the installed position on the frame 14. In the example provided, the die 26 is a unitary body that includes a locating pin 126 and a head 130. The locating pin 126 extends from a bottom side 134 of the head 130 and is configured to be securely received in an aperture 138 defined by the frame 14 (e.g., the die post 78 or bottom member 66). In the example provided, the locating pin 126 is a cylindrical body, though other shapes, such as those with a clocking/locating feature, can be used. With the locating pin 126 received in the aperture 138, the bottom side 134 of the head 130 rests on the frame 14. Workpieces 142, 146 (e.g., two pieces of material to be riveted together) are placed between the setter 22 and the installed die 26. The actuator 18 (FIG. 1) is activated to move the nose 110 toward the workpieces 142, 146.

In step 2, the actuator 18 (FIG. 1) moves the nose 110 until it contacts the top workpiece 142 and holds the workpieces 142, 146 against the top surface 150 of the die 26. While the nose 110 remains stationary relative to the workpieces 142, 146 and the die 26, the actuator 18 (FIG. 1) translates the punch 114 axially within the nose 110. The punch 114 also translates the rivet 122 within the nose 110 toward the workpieces 142, 146. At step 3, the punch 114 has been moved until the rivet 122 initially makes contact with the top workpiece 142, and before the rivet 122 deforms the workpieces 142, 146.

In order to attach the workpieces 142, 146 to each other with the rivet 122, the riveting operation proceeds such that the actuator 18 (FIG. 1) continues to move the punch 114 toward the die 26 so that the rivet 122 begins to deform the workpieces 142, 146, as shown in step 4. As shown in steps 5 and 6, the actuator 18 (FIG. 1) continues to move the punch 114 toward the die 26 to cause the rivet 122 to penetrate the top workpiece 142, and the rivet 122 and workpieces 142, 146 are deformed against the die 26 until the rivet 122 secures the workpieces 142, 146 together. The head 130 of the die 26 can have a shape/recess configured to guide the deformation of the workpieces 142, 146 and rivet 122 as shown. For example, the head 130 can include a cavity 154 that is recessed from the top surface 150 of the die 26, though other configurations/features, both into and out of the top surface 150, can be used. While not specifically shown, after the workpieces 142, 146 are secured together by the rivet 122, the actuator 18 (FIG. 1) reverses its direction to release the workpieces 142, 146 with the installed rivet 122 from the setter 22.

Returning to FIG. 1, the control module 38 is in communication with the actuator 18. In the example provided, the control module 38 is also in communication with the input device 58, the output device, the first sensor 30, and the second sensor 34. The control module 38 is configured to control operation of the actuator 18. The input device 58 can be any suitable input device 58, such as a keyboard, a mouse, a touch screen, an optical scanner, and/or a separate device (e.g., separate computer or control module). The input device 58 is configured to receive input and transmit signals indicative of the input to the control module 38. For example, a user or separate device (e.g., a control module of the robotic arm, not shown) can provide input to the input device 58 in order to specify operating parameters of the rivet tool 10. One type of input may include a user entering or a joining schedule providing a desired rivet location identifier that corresponds to a desired rivet operation (e.g., corresponding to desired workpieces, desired rivet, desired die, and the location on the workpieces).

The output device 54 is configured to receive signals from the control module 38. The output device 54 can be configured to produce an output that can be received by a user or separate device (not shown). Such output can be any suitable output perceivable by a user, such as a visual cue, an audible cue, or a tactile cue, or can be an output signal to be received by the separate device (not shown). In one construction, the output device 54 can be a display screen configured to display words, text, and/or images. Additionally, or alternatively, the output device 54 can include one or more lights, speakers, and/or haptic mechanisms.

In another construction, the output device 54 can be the control module of the robotic arm (not shown) such that the control module 38 can output a signal that is received by a separate control module and used therein to control the robotic arm. In another construction, the control module 38 of the rivet tool 10 and the control module of the robotic arm (not shown) can be one in the same, such that the output device 54 can be the robotic arm and the output can be the motion or positioning of the arm. While described in terms of their functions, the input device 58 and the output device 54 do not need to be physically distinct devices, such as with a touchscreen that performs both the input and output functions, or a separate device (e.g., the robotic arm, not shown) that provides input to the control module 38 and receives output from the control module 38.

The data storage device 50 can be any device or devices configured to store data. The data storage device 50 can be local to the control module 38, or can be remotely located and accessed by the control module 38 via wired or wireless communication. In the example provided, the data storage device 50 stores data corresponding to configurations and parameters of the rivet tool 10 including the rivets 122 and dies 26, 26', 26". For example, the data storage device 50 can include a joining schedule that includes all of the programs for the rivet tool 10 that correspond to specific rivet locations on specific workpieces. For example, the joining schedule can include all of the actions or routines that the rivet tool 100 should perform, categorized by the rivet location identifier. The data storage device 50 can additionally or alternatively include a look-up table that includes dimensions of the nose 110 and punch 114 as well as dimensions of different dies (e.g., dies 26, 26', 26") and different rivets 122 that correspond to the different dies (e.g., dies 26, 26', 26"). The control module 38 is configured to access the data stored in the data storage device 50.

The first sensor 30 is coupled to the actuator 18 or the setter 22 and is configured to detect an operating force or a condition that corresponds to the operating force, such that the operating force can be calculated, and to output a signal to the control module 38 that is indicative of that operating force. For example, the first sensor 30 can be a pressure sensor that measures the operating hydraulic pressure within a hydraulic actuator. In a construction in which the actuator 18 is a motor driven actuator, the first sensor 30 can detect a characteristic that corresponds in a known way to the force exerted on the rivet 122. Some non-limiting examples include a force transducer, a velocity sensor or an acceleration sensor, a torque sensor, or an electrical current sensor, though other types of sensors can be used.

Returning to the example provided, the second sensor 34 is coupled to the actuator 18 or the setter 22 and is configured to directly or indirectly detect a position or displacement of the punch 114 and to output a signal to the control module 38 that is indicative of that position or displacement. For example, the second sensor 34 can be an optical sensor, a proximity sensor, hall-effect sensor, limit switches, a rotational position sensor correlated to rotation of a motor of the actuator, or any other suitable sensing device capable of detecting a position of the punch 114 relative to a known zero position of the punch 114.

Figure 3:
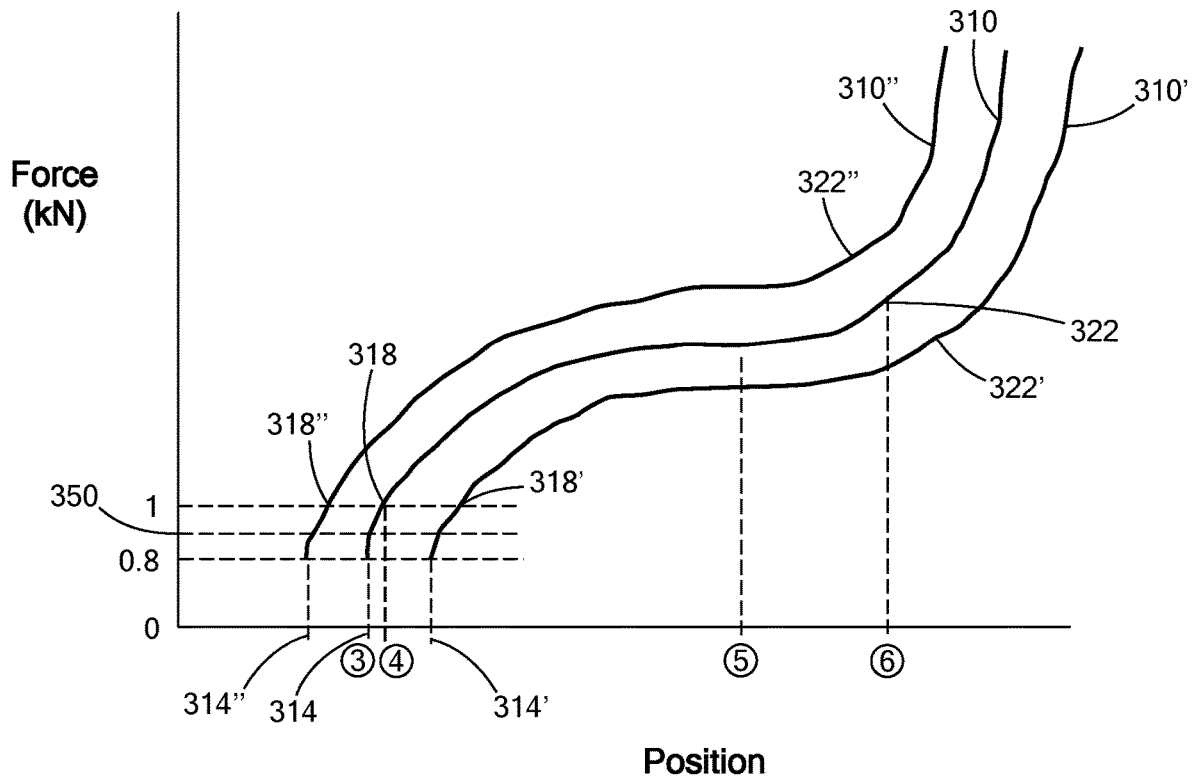
FIG. 3 is a graph of force versus position of a punch of the self-piercing rivet device of FIG. 1.

Referring to FIGS. 2 and 3, FIG. 3 is a graph in which operating force of the punch 114 is illustrated by trace 310 as a function of position of the punch 114 while the rivet tool 10 performs the steps shown in FIG. 2. In the example provided, the operating force of the punch 114 can be considered negligible at steps 1 and 2 before the rivet 122 contacts the top workpiece 142 and, thus, the force during steps 1 and 2 is not shown in the graph. In the non-limiting example provided, the operating force of the punch 114 is approximately zero before the rivet 122 contacts the top workpiece 142, though it can be a small amount greater than zero (e.g., 0-0.8 kilonewtons).

At step 3, the punch 114 is at position 314 and initially contacts the top workpiece 142. As the punch 114 presses the rivet 122 against the top workpiece 142, the operating force rises sharply with increased movement of the punch 114 toward the die 26. The force rises sharply until it is sufficient to deform the workpieces 142, 146 against the die 26, as shown at step 4 of FIG. 2 and at the position corresponding approximately to location 318 on the trace 310 of FIG. 3. Insignificant deformation of the top workpiece 142 can occur between position 314 and 318. Insignificant deformation is considered no deformation or such minor deformation that stopping the riveting process between positions 314 and 318 would not result in the need to scrap the workpieces 142, 146 or the rivet 122. For example, deformation less than that shown at step 4 of FIG. 2 in which both the top and bottom workpieces 142, 146 are deformed. In the particular non-limiting example provided, greater than insignificant deformation occurs when the operating force of the punch 114 reaches a threshold of approximately 1 kilonewton. As the punch 114 continues to move toward the die 26 after position 318, the force continues to rise, but at a slower rate due to the yielding of the workpieces 142, 146 and the rivet 122. At step 6, as the rivet 122 nears full deformation of the workpieces 142, 146 against the die 26, the force begins to rise sharply again at approximately location 322 on the trace 310 of FIG. 3.

Figure 4:
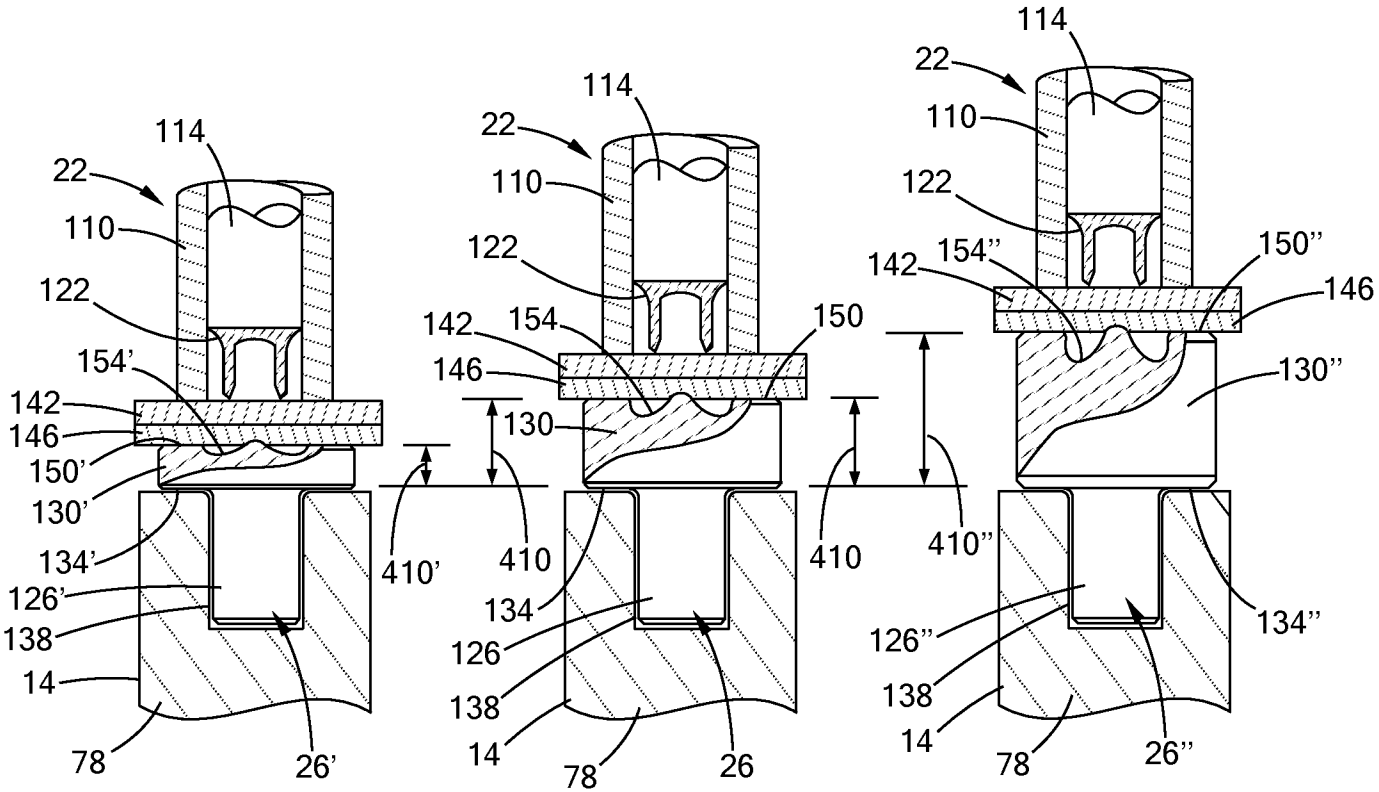
FIG. 4 is a partial cross-sectional view of a portion of the self-piercing rivet device of FIG. 1, illustrating different setter positions when workpieces are pressed between a setter and dies of different heights.

Referring to FIG. 4, the rivet tool 10 is illustrated with the rivet 122 and three different dies (e.g., the die 26, a die 26', and a die 26"). Each die 26, 26', 26" is configured to be mounted in the installed position on the frame 14. In the example provided, the locating pins 126, 126', 126" have the same shape, diameter, and length, so that they all can interchangeably fit within the aperture 138 of the frame 14. Thus, the dies 26, 26', 26" collectively form a set of dies interchangeably mountable on the frame 14. The dies 26, 26', 26" can be mounted on the frame by a user or by a separate automated mounting device (not shown).

As shown, the head 130' of the die 26' is shorter than the head 130 of the die 26. In other words, the distance 410' between the bottom side 134' and the top surface 150' is less than the distance 410 between the bottom side 134 and the top surface 150. This difference in die height is greater than the tolerance stack-up of the workpieces 142, 146, the setter 22, and the rivet 122. In the example provided, the die 26' is designed for use at a different rivet location that has a different combination of riveting characteristics (e.g., workpiece thickness, workpiece material, rivet geometry, rivet hold characteristics, etc.) than die 26. As a result, the dies 26 and 26' have different shaped or sized cavities 154, 154' or other surface features only suitable for the rivet locations for which each was designed. In other words, the die 26 is not suitable for use at the rivet locations that die 26' is designed for.

Returning to FIG. 3, trace 310' illustrates the graph of force versus position of the punch 114 with the shorter die 26'. Since the height of die 26' is less than the height of die 26, the punch 114 must move further before the rivet 122 contacts the top workpiece 142 when the die 26' is used. Thus, as shown in trace 310', the operating force does not begin to sharply increase until a greater (i.e., later) punch position than that of trace 310. In other words, position 314' is a further than position 314.

Returning to FIG. 4, the head 130" of the die 26" is taller than the head 130 of the die 26. In other words, the distance 410" between the bottom side 134" and the top surface 150" is greater than the distance 410 between the bottom side 134 and the top surface 150. This difference in die height is greater than the tolerance stack-up of the workpieces 142, 146, the setter 22, and the rivet 122. In the example provided, the die 26" is designed for use at a different rivet location that has a different combination of riveting characteristics (e.g., workpiece thickness, workpiece material, rivet geometry, rivet hold characteristics, etc.) than the dies 26 and 26'. As a result, the dies 26, 26', and 26" have different shaped or sized cavities 154, 154', 154" or other surface features only suitable for the rivet locations for which it was designed. In other words, the die 26 and 26' is not suitable for use at the rivet locations that die 26" is designed for.

Returning to FIG. 3, trace 310" illustrates the graph of force versus position of the punch 114 with the taller die 26". The locations along trace 310" indicate similar steps in the riveting operation as the locations along trace 310 but are indicated with double primed reference numerals. Accordingly, only differences are described herein. Since the die height of die 26" is greater than the die height of die 26, the punch 114 must move a lesser distance before the rivet 122 contacts the top workpiece 142 when the die 26" is used. Thus, as shown in trace 310", the operating force begins to sharply increase at a lesser (i.e., earlier) punch position than that of trace 310. In other words, position 314 is a further than position 314". The shapes of the curves of the traces 310, 310', and 310" are provided for illustration purposes and can be different from those shown, but the general relationship between the starts and ends of the curves would remain.

Figure 5:
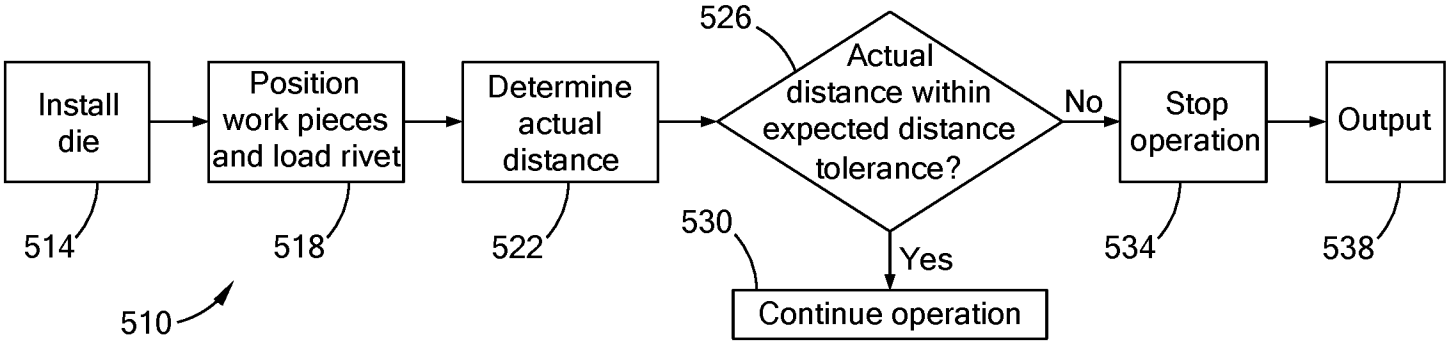
FIG. 5 is a flow chart of a method of operating the rivet tool of FIG. 1 in accordance with the teachings of the present disclosure.

Referring now to FIG. 5, a flow chart of a method 510 of operating the rivet tool 10 is illustrated. At step 514 a die (e.g., one of dies 26, 26', 26") is mounted to the frame 14 in the installed position aligned with the setter 22. The method 510 proceeds to step 518, where the workpieces 142, 146 are positioned between the setter 22 and the die 26, 26', 26". At or before step 518, the rivet 122 is loaded into the nose 110. The method then proceeds to step 522, before which time the control module 38 can optionally perform other tests, such as a material check, in which the type or thickness of the workpieces 142, 146 are verified, or a rivet check, in which the rivet 122 loaded in the nose 110 is verified as the correct rivet. These other tests can be done in any suitable manner.

At step 522, the control module 38 operates the rivet tool 10 to determine the actual stroke distance. Determination of the actual stroke distance is described in greater detail below with reference to FIG. 6.

After the actual stroke distance is determined, the method proceeds to step 526, where the control module 38 compares the actual stroke distance to an expected stroke distance. Since each die 26, 26', 26" has a different height and the actual stroke distance depends on the height of the die 26, 26', 26", and because the length of the rivet 122 and setter 22 are known, then a determination of whether or not the actual stroke distance is within tolerances of the expected stroke distance can be used to determine if the correct die 26, 26', 26" is installed.

In the example provided, the expected stroke distance is a predetermined value or range of values stored on the data storage device 50, such as in the joining schedule or a look-up table, for example. The control module 38 accesses the data storage device 50 and receives the expected stroke distance from the data storage device 50. In one configuration, the robotic arm (not shown) moves the rivet tool 10 to a specific location on the workpieces 142, 146, then sends a signal to the control module 38 of the rivet tool 10 to indicate that the rivet tool 10 is in that specific rivet location. The control module 38 then accesses the joining schedule in the data storage device 50 and retrieves the parameters that correspond to that specific rivet location. These parameters can include the expected stroke distance for that specific rivet location.

In a different configuration, the control module 38 can be pre-programmed for only operating at a specific rivet location and can look up and retrieve the expected stroke distance based on that pre-programmed rivet location. In another configuration, the rivet location identifier or an expected stroke distance can be entered into the input device 58 by a user.

The expected stroke distance is based on the geometry of the rivet 122 (e.g., rivet diameter, rivet head style, rivet length, and/or rivet thickness), the punch 114, the workpieces 142, 146, the nose 110, and the appropriate die for the rivet location (e.g., die 26), and accounting for any manufacturing tolerances of these components (i.e., tolerance stack-up). In other words, the expected stroke distance can have a minimum value and a maximum value for each particular rivet location. Comparison of the actual stroke distance to the expected stroke distance is described in greater detail below.

If the control module 38 determines that the actual stroke distance is within predetermined acceptable limits of the expected stroke distance, then the method 510 proceeds to step 530. At step 530, the control module 38 continues to operate the rivet tool 10 to complete the riveting operation (e.g., through to step 6 of FIG. 2). Alternatively or additionally, the control module 38 can send a signal to the output device 54 to output an indication that the correct die 26 is installed, such as the visual, audible, and/or tactile cues.

If the control module 38 determines that the actual stroke distance is not within the predetermined acceptable limits of the expected stroke distance, then the method 510 proceeds to step 534. At step 534, the control module stops operation of the rivet tool 10 before the rivet 122 and workpieces 142, 146 are significantly deformed against the die 26, 26', 26" (i.e., stopping at step 3 and before step 4 of FIG. 2). At step 538, the control module 38 optionally sends a signal to the output device 54 to output an indication that the incorrect die (e.g., die 26', or 26") is installed, such as the visual, audible, and/or tactile cues. In one configuration, the control module 38 can also create a fault condition that prevents the rivet tool 10 from completing any further riveting operations until a user clears the fault condition (e.g., via the input device 58).

Figure 6:
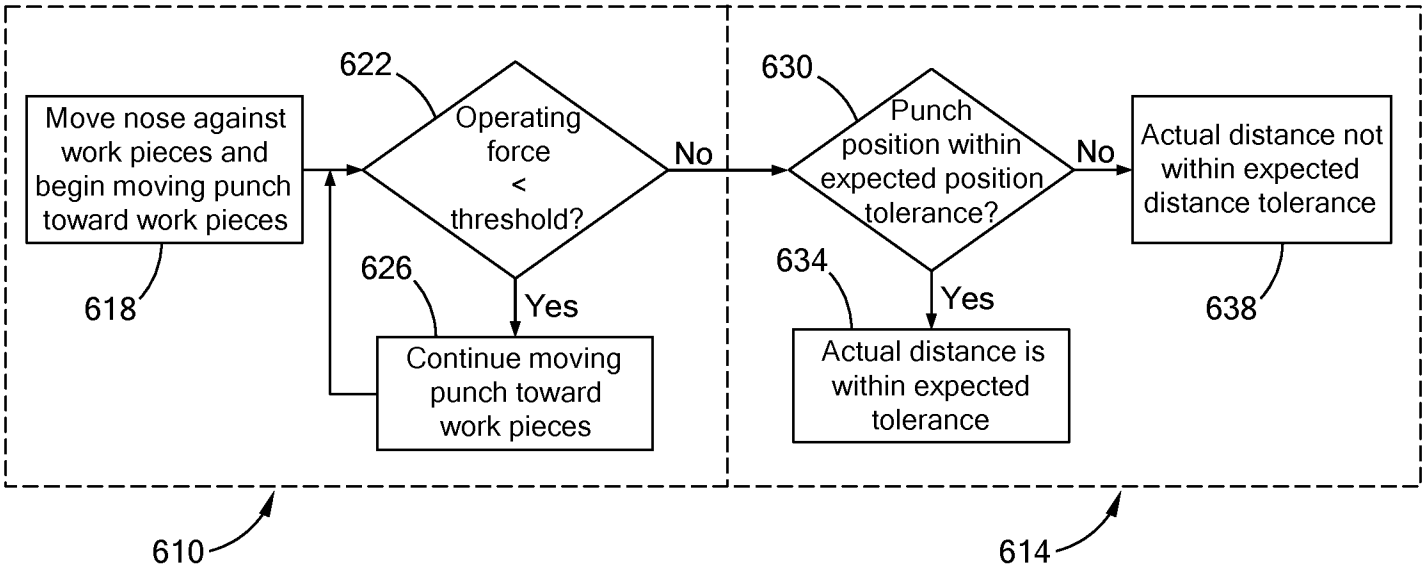
FIG. 6 is a flow chart of a method of determining an actual stroke distance and if the actual stroke distance is within an expected stroke distance in accordance with the teachings of the present disclosure.

Referring now to FIG. 6 one non-limiting example of a method of determining the actual stroke distance (e.g., step 522 of the method 510 of FIG. 5) is illustrated by method 610 (surrounded by the left dashed box), though the actual stroke distance can be determined in other ways. One non-limiting example of a method of comparing the actual stroke distance to the expected stroke distance (e.g., step 526 of the method 510 of FIG. 5) is illustrated by method 614 (surrounded by the right dashed box), though the actual stroke distance can be compared to the expected stroke distance in other ways.

The method 610 of determining the actual stroke distance includes step 618, in which the control module 38 operates the actuator 18 to move the nose 110 of the setter 22 toward the workpieces 142, 146 and begin moving the punch 114 within the nose 110. As shown in step 2 of FIG. 2, the nose 110 can contact the workpieces 142, 146 before the punch 114 presses the rivet 122 against the top workpiece 142. As the control module 38 is operating the actuator 18, the control module 38 receives signals indicative of the operating force from the first sensor 30 and receives signals indicative of the punch position from the second sensor 34. The control module 38 calculates the force and/or the position based on the signals received.

At step 622, the control module 38 monitors the signals from first sensor 30 and compares either these signals to a predetermined threshold for the signal, or uses the signal to calculate the operating force and compares that calculated force to a predetermined threshold for the force. The predetermined threshold can be one of the parameters that correspond to the desired rivet location (e.g., stored in the data storage device 50 within the joining schedule). The predetermined threshold corresponds to an operating force that is greater than the force necessary to move the setter 22 through steps 1 and 2 of FIG. 2. In other words, the predetermined threshold corresponds to a force that is greater than the force needed to move the setter 22 before the rivet 122 contacts the top workpiece 142. The force that the predetermined threshold corresponds to is also less than the force necessary to significantly deform the rivet 122 and/or the workpieces 142, 146 at step 4 of FIG. 2. In other words, the predetermined threshold is along the first sharp rise of the trace 310 in FIG. 3, before location 318. In the example provided, the predetermined threshold is indicated by reference numeral 350 on FIG. 3.

As shown in step 626, so long as the operating force remains less than the predetermined threshold, then the control module 38 continues to operate the actuator 18 to continue to move the punch 114 toward the workpieces 142, 146. When the operating force reaches the threshold, the actual stroke distance is achieved and the method 610 outputs the actual position of the punch 114 to the method 614. Since the actual position is directly correlated to the stroke distance (i.e., the start position is a known value), the actual stroke distance is indirectly determined. Thus, the method 610 could alternatively calculate and output the actual stroke distance instead of the actual position of the punch 114.

At step 630 of method 614, the control module 38 compares the actual punch position when the actual stroke distance is achieved with an expected punch position. The expected punch position can be one of the parameters that correspond to the desired rivet location (e.g., stored in the data storage device 50 within the joining schedule). The control module 38 compares the actual punch position and expected punch position directly or indirectly. For example, the positions can be compared indirectly by using the punch position values to calculate or look up other values that are comparable. In other words, the control module 38 can use the known geometry of the components of the rivet tool 10 to calculate the position of the nose 110, or the height of the die 26 and compare these values since these correlate to the actual and expected punch position. Similarly, since the actual position is directly correlated to the stroke distance, the actual stroke distance can be compared to the expected stroke distance.

Since each die 26, 26', 26" has a different height and the actual punch position depends on the height of the die 26, 26', 26", and because the length of the rivet 122 and punch 114 are known, then a determination of whether or not the actual punch position is within tolerances of the expected punch position can be used to determine if the correct die 26, 26', 26" is installed.

In one configuration, each rivet location in the joining schedule has a corresponding expected punch position that is a predetermined value or range of values. The control module 38 can access and receive the expected punch position from the data storage device 50 when it retrieves the parameters for the desired rivet location. In a different configuration, the control module 38 can be pre-programmed for only operating at a specific rivet location and can look up and retrieve the expected punch position based on that pre-programmed rivet location. In another configuration, the rivet location identifier or expected punch position can be entered into the input device 58 by a user.

The expected punch position can be a range that is based on the geometry of the rivet 122, the punch 114, the workpieces 142, 146, the nose 110, and the appropriate die for the rivet location (e.g., die 26), and accounting for any manufacturing tolerances of these components (i.e., tolerance stack-up). In other words, the expected punch position can have a minimum value and a maximum value for each particular rivet location and directly correlates to the expected stroke distance.

If the control module 38 determines that the actual punch position is within predetermined acceptable limits of the expected punch position, then the method 614 proceeds to step 634. At step 634, the method 614 outputs that actual stroke distance is within the expected stroke distance tolerances. Accordingly, the method 510 of FIG. 5 would proceed from step 526 to step 530.

If the control module 38 determines that the actual punch position is not within the predetermined acceptable limits of the expected punch position, then the method 614 can proceed to step 638. At step 638, the method 614 outputs that the actual stroke distance is not within the expected stroke distance tolerances. Accordingly, the method 510 of FIG. 5 would proceed from step 526 to step 534.

In summary, the teachings of the present disclosure provide for a self-piercing rivet tool and a method of operating the self-piercing rivet tool that ensures a correct die is installed for a given rivet before riveting workpieces with that rivet and before significantly deforming the workpieces in a manner that would result in requiring them to be scrapped or re-worked.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method of operating a riveting tool, the method comprising:

mounting a die in an installed position;

determining an actual stroke distance of the riveting tool;

comparing the actual stroke distance to a predetermined stroke distance before installing a rivet, the predetermined stroke distance being based on a desired rivet location; and based on the result of the comparison, operating the riveting tool to install the rivet into workpieces with the die if the actual stroke distance is within acceptable limits of the predetermined stroke distance or changing the die to a different die before installing the rivet and then operating the riveting tool to install the rivet into the workpieces if the actual stroke distance is not within acceptable limits of the predetermined stroke distance.

2. The method of claim 1, further comprising receiving an input of a desired rivet location identifier that corresponds to the desired rivet location.

3. The method of claim 1, wherein the riveting tool includes a punch configured to press the rivet toward the die, and the step of determining the actual stroke distance includes determining an operating pressure or force of the punch.

4. The method of claim 3, wherein the step of determining the actual stroke distance further includes determining a height of the die or a position of a setter aligned with the die when the operating pressure or force exceeds a threshold operating pressure or force.

5. The method of claim 4, further comprising:

positioning workpieces between the setter and the die; and moving the punch to press the rivet against the workpieces;

wherein the threshold operating pressure or force is insufficient for the rivet to significantly deform the workpieces against the die.

6. The method of claim 3, wherein the step of determining the actual stroke distance includes determining a position of the punch when the operating pressure or force exceeds a threshold operating pressure or force.

7. The method of claim 6, further comprising determining a die height or a setter position based on thicknesses of the workpieces, a length of the rivet, and the position of the punch when the operating pressure or force exceeds the threshold operating pressure or force.

8. The method of claim 7, wherein the threshold operating pressure or force is insufficient for the rivet to significantly deform the workpieces.

9. The method of claim 3, wherein the operating pressure or force is calculated based on characteristics of an actuator that is configured to move the punch.

10. The method of claim 1, wherein the step of determining the actual stroke distance includes operating a servomotor configured to move the setter toward the die and measuring a servomotor rotational displacement when the setter contacts the workpieces.

11. The method of claim 1, further comprising indicating the result of the comparison by at least one of a visual cue, an audible cue, or a tactile cue.

12. The method of claim 1, wherein the die is one of a set of dies, each die of the set of dies corresponding to a different set of riveting characteristics, wherein each die of the set of dies has a different height when mounted in the installed position.

13. A method of operating a riveting tool, comprising:

positioning workpieces between a setter and a die;

pressing a rivet against the workpieces until an operating force exceeds a threshold that is an amount of force insufficient for the rivet to significantly deform the workpieces against the die;

comparing an actual stroke distance to a predetermined stroke distance when the operating force exceeds the threshold, the comparison occurring before significantly deforming the workpieces against the die; and based on the comparison result, operating or not operating the riveting tool in a manner to install the rivet into the workpieces.

14. The method of claim 13, further comprising indicating the comparison result by at least one of a visual cue, an audible cue, and a tactile cue.

15. The method of claim 13, wherein the predetermined stroke distance is based on a rivet location identifier.

16. The method of claim 15, further comprising:

moving a frame of the riveting tool with a robotic arm to position the workpieces between the setter and the die at a rivet location;

sending the rivet location identifier from the robotic arm to a control module of the riveting tool when the riveting tool is at the rivet location;

loading a combination of riveting characteristics from a joining schedule, the riveting characteristics corresponding to the rivet location identifier and including the predetermined stroke distance.

17. The method of claim 13, wherein the die is one of a set of dies, each die of the set of dies corresponding to a different set of riveting characteristics, wherein each die of the set of dies has a different height when mounted in an installed position on a frame of the riveting tool.

18. A method of operating a riveting tool, comprising:

positioning workpieces between a setter and a die by moving a frame of the riveting tool to position the workpieces between the setter and the die at a rivet location;

sending a rivet location identifier to a control module of the riveting tool when the riveting tool is at the rivet location;

loading a combination of riveting characteristics from a joining schedule, the riveting characteristics corresponding to the rivet location identifier and including a predetermined stroke distance that is based on the rivet location identifier;

pressing a rivet against the workpieces until an operating force exceeds a threshold;

comparing an actual stroke distance to the predetermined stroke distance when the operating force exceeds the threshold; and based on the comparison result, operating or not operating the riveting tool in a manner to install the rivet into the workpieces.

* * * * *